US007434752B2

(12) United States Patent
Matsumoto et al.

(10) Patent No.: US 7,434,752 B2
(45) Date of Patent: Oct. 14, 2008

(54) FUEL INJECTION VALVE

(75) Inventors: Eishi Matsumoto, Miyagi (JP); Koji Kitamura, Miyagi (JP); Gaku Sato, Miyagi (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 10/574,235

(22) PCT Filed: Oct. 5, 2004

(86) PCT No.: PCT/JP2004/014630

§ 371 (c)(1),
(2), (4) Date: Mar. 20, 2007

(87) PCT Pub. No.: WO2005/035974

PCT Pub. Date: Apr. 21, 2005

(65) Prior Publication Data

US 2007/0262176 A1 Nov. 15, 2007

(30) Foreign Application Priority Data

Oct. 8, 2003 (JP) ..... 2003-349972

(51) Int. Cl.

| | |
|---|---|
| ***F02M 51/00*** | (2006.01) |
| ***F02M 61/00*** | (2006.01) |
| ***F02M 61/04*** | (2006.01) |
| ***F02M 61/18*** | (2006.01) |
| ***B05B 1/30*** | (2006.01) |

(52) U.S. Cl. ..... 239/585.4; 239/533.12; 239/585.1; 239/900

(58) Field of Classification Search ..... 239/585.4, 239/533.12, 585.1, 900, 533.2, 533.3, 533.9, 239/533.11, 533.14, 596
See application file for complete search history.

(56) References Cited

U.S. PATENT DOCUMENTS

| | | | | |
|---|---|---|---|---|
| 4,101,074 | A | 7/1978 | Kiwior et al. | |
| 5,570,841 | A * | 11/1996 | Pace et al. | 239/585.1 |
| 6,170,763 | B1 * | 1/2001 | Fuchs et al. | 239/533.12 |

(Continued)

FOREIGN PATENT DOCUMENTS

| | | | |
|---|---|---|---|
| JP | 8-232813 | A | 9/1996 |

(Continued)

*Primary Examiner*—Darren W Gorman
(74) *Attorney, Agent, or Firm*—Arent Fox LLP.

(57) ABSTRACT

A fuel injection valve is provided that includes a valve seat member (3) having provided therein a conical valve seat (8) and a valve seat hole (7) communicating with the downstream end of the valve seat (8), a flat fuel diffusion chamber (43) radially extending from the valve seat hole (7), the fuel diffusion chamber (43) being formed between the valve seat member (3) and an injector plate (10), and a plurality of fuel injection holes (11) bored in the injector plate (10) so as to open in the fuel diffusion chamber (43), wherein the fuel injection holes (11) are arranged so as to be radially outwardly separated from the valve seat hole (7), and when the height of the fuel diffusion chamber (43) is t1 and the length of the valve seat hole (7) is t2, t2/t1≧2. It is thereby possible to atomize injected fuel effectively by logically setting the relationship between the length of the valve seat hole and the height of the fuel diffusion chamber, and the relative positional relationship between the valve seat hole and the fuel injection holes.

2 Claims, 5 Drawing Sheets

U.S. PATENT DOCUMENTS

| | | | | |
|---|---|---|---|---|
| 6,405,946 | B1 * | 6/2002 | Harata et al. | 239/533.12 |
| 6,427,659 | B2 | 8/2002 | Shiraishi et al. | |
| 6,742,727 | B1 | 6/2004 | Peterson, Jr. | |
| 6,779,743 | B2 * | 8/2004 | Kitamura | 239/533.12 |
| 6,783,085 | B2 * | 8/2004 | Xu | 239/463 |
| 6,817,545 | B2 * | 11/2004 | Xu | 239/533.12 |
| 2002/0063174 | A1 | 5/2002 | Arioka et al. | |
| 2002/0063175 | A1 | 5/2002 | Kitamura et al. | |
| 2002/0130193 | A1 | 9/2002 | Peterson, Jr. | |
| 2003/0057300 | A1 | 3/2003 | Peterson, Jr. | |
| 2003/0127540 | A1 | 7/2003 | Xu | |
| 2003/0141387 | A1 * | 7/2003 | Xu | 239/533.12 |
| 2004/0050976 | A1 * | 3/2004 | Kitamura | 239/584 |

FOREIGN PATENT DOCUMENTS

| | | | |
|---|---|---|---|
| JP | 9-250423 | A | 9/1997 |
| JP | 2000-97129 | A | 4/2000 |
| JP | 2002-4983 | A | 1/2002 |
| JP | 2002-130074 | A | 5/2002 |
| JP | 2002-130082 | A | 5/2002 |
| JP | 2003-13824 | A | 1/2003 |
| JP | 2003-148299 | A | 5/2003 |
| JP | 2003-155965 | A | 5/2003 |
| JP | 2003155965 | A | 5/2003 |
| JP | 2003-206828 | A | 7/2003 |

* cited by examiner

FUEL INJECTION VALVE

CROSS-REFERENCE TO RELATED APPLICATION

This application is a National Stage entry of International Application No. PCT/JP2004/014630, filed Oct. 5, 2004, the entire specification claims and drawings of which are incorporated herewith by reference.

TECHNICAL FIELD

The present invention relates to a fuel injection valve that is used mainly in a fuel supply system of an internal combustion engine and, in particular, to an improvement of a fuel injection valve having provided in a valve seat member a conical valve seat that cooperates with a valve portion of a valve assembly and a valve seat hole that communicates with the downstream end of the valve seat, and having formed between the valve seat member and an injector plate joined thereto a radially extending and flat fuel diffusion chamber, the downstream end of the valve seat hole opening in a central part of the fuel diffusion chamber, and a plurality of fuel injection holes being bored in the injector plate so as to open in the fuel diffusion chamber.

BACKGROUND ART

Such an internal combustion engine fuel injection valve is already known, as disclosed in the following Patent Publication 1.

Patent Publication 1: Japanese Patent Application Laid-open No. 2000-97129.

DISCLOSURE OF THE INVENTION

Problem to be Solved by the Invention

In such a fuel injection valve, the aim is to make the fuel spray direction and the fuel spray angle correctly correspond to the direction and the shape of each fuel injection hole by diffusing high pressure fuel, which has passed through the valve seat and the valve seat hole, in a diffusion chamber and then injecting the fuel from the fuel injection holes.

However, in the conventional arrangement, the fuel that has been injected from the fuel injection holes is not sufficiently atomized and, moreover, a predetermined fuel flow rate cannot be obtained. It has been found that the above problems are due to an illogical relationship between the length of the valve seat hole and the height of the fuel diffusion chamber, and due to an illogical relative positional relationship between the valve seat hole and the fuel injection holes.

The present invention has been achieved under the above-mentioned circumstances, and it is an object thereof to provide a fuel injection valve that enables fuel injected from fuel injection holes to be atomized effectively and a predetermined fuel flow rate to be obtained by logically setting the relationship between the length of a valve seat hole and the height of a fuel diffusion chamber, and the relative positional relationship between the valve seat hole and the fuel injection holes.

Means for Solving the Problem

In order to attain this object, in accordance with a first aspect of the present invention, there is provided a fuel injection valve that includes a valve assembly having a valve portion; a valve seat member having provided therein a conical valve seat and a valve seat hole, the conical valve seat cooperating with the valve portion, and the valve seat hole communicating with the downstream end of the valve seat; an injector plate, the injector plate being joined to the valve seat member; a radially extending and flat fuel diffusion chamber, the fuel diffusion chamber being formed between the valve seat member and the injector plate, and the downstream end of the valve seat hole opening in a central part of the fuel diffusion chamber; and a plurality of fuel injection holes, the fuel injection holes being bored in the injector plate so as to open in the fuel diffusion chamber; wherein the fuel injection holes are arranged so as to be radially outwardly separated from the valve seat hole, and when the height of the fuel diffusion chamber is t1 and the length of the valve seat hole is t2, $t2/t1 \geqq 2$.

Furthermore, in accordance with a second aspect of the present invention, in addition to the first aspect, there is provided the fuel injection valve wherein the height of a section of the fuel diffusion chamber that the fuel injection holes face is 20 to 110 μm.

Moreover, in accordance with a third aspect of the present invention, in addition to the first or second aspect, there is provided the fuel injection valve wherein an angled section between the valve seat hole and the fuel diffusion chamber is given a chamfer.

Furthermore, in accordance with a fourth aspect of the present invention, in addition to any one of the first to the third aspects, there is provided the fuel injection valve wherein the fuel diffusion chamber is formed so that the height thereof decreases when going in a radially outward direction.

EFFECT OF THE INVENTION

In accordance with the first aspect of the present invention, when the valve opens, fuel that has passed through the valve seat firstly goes down the valve seat hole. Since this valve seat hole is sufficiently long compared with the length of the diffusion chamber, the flow of fuel is straightened effectively and the fuel can thus move to the fuel diffusion chamber, thereby enabling retention of fuel to be prevented.

The fuel that has moved from the valve seat hole to the fuel diffusion chamber, which is flat and very thin compared with the length of the valve seat hole, spreads radially outward at high speed and collides forcefully with an inner peripheral wall of the fuel diffusion chamber, thus enabling the pressure of each section of the fuel diffusion chamber to be increased equally; as a result the fuel is injected from the fuel injection holes with an equally high pressure in each section, and it is therefore possible to promote atomization of the fuel injected from the fuel injection holes and stabilize the direction and the shape of the spray form at all times. Moreover, since the fuel is not retained because its flow is straightened in the valve seat hole, it is possible to prevent the fuel flow rate from decreasing and ensure that a predetermined amount of fuel is injected.

Furthermore, in accordance with the second aspect of the present invention, the fuel that has moved from the valve seat hole to the fuel diffusion chamber spreads radially in film form at high speed, and when the fuel in film form is injected from the fuel injection holes at high speed, the fuel flow is detached from the inner peripheral wall of the fuel injection holes, thus enabling atomization of the injected fuel to be promoted yet more effectively. Moreover, it is possible to minimize dead volume due to the fuel diffusion chamber, thus stabilizing the fuel flow rate characteristics against changes in temperature. Furthermore, outflow of fuel remaining in the fuel diffusion chamber is avoided due to the capillary action, thus preventing the fuel from dripping from the fuel injection holes after fuel injection and thereby enabling a contribution to be made to a reduction in exhaust emissions of the internal combustion engine.

Moreover, in accordance with the third aspect of the present invention, the fuel moves smoothly from the valve seat hole to the fuel diffusion chamber, thus enabling any decrease in the fuel flow rate or pressure in the fuel diffusion chamber to be prevented.

Furthermore, in accordance with the fourth aspect of the present invention, the fuel diffusion chamber has a logical shape that substantially corresponds to the flow of fuel, that is, the height of the fuel diffusion chamber decreases as the fuel spreads radially outward, and as a result the pressure of the fuel diffusion chamber can be increased by the fuel yet more equally in each section, thus promoting atomization of the fuel injected from the fuel injection holes yet further and stabilizing the spray form yet further.

DESCRIPTION OF REFERENCE NUMERALS AND CHARACTERS

Figure 1:
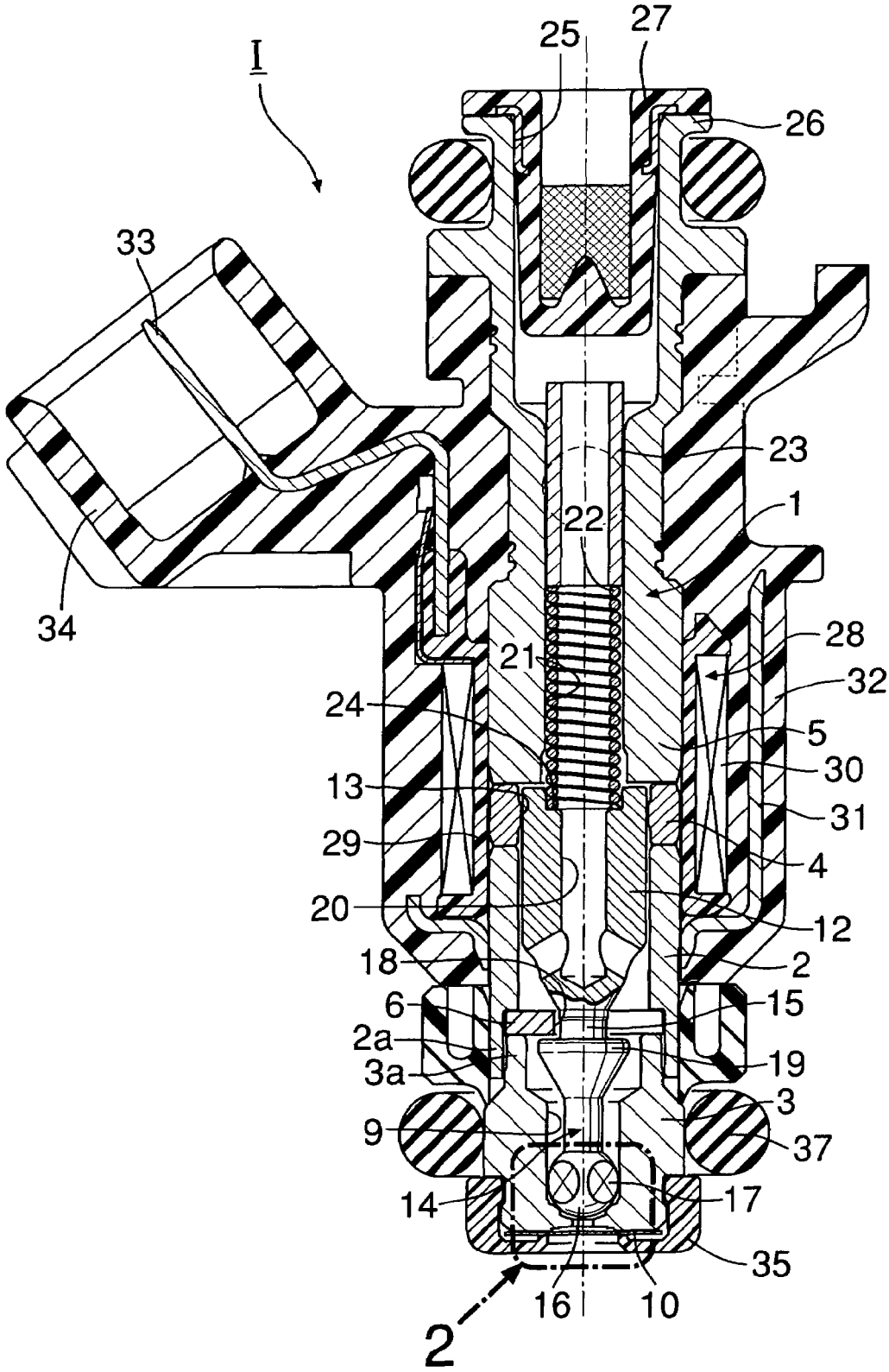
FIG. 1 is a vertical sectional view of a solenoid type fuel injection valve for an internal combustion engine related to a first embodiment of the present invention (Embodiment 1).

I solenoid type fuel injection valve
3 valve seat member
4 spacer
7 seat hole
8 valve seat
10 injector plate
11 fuel injection hole
14 valve assembly
16 valve portion
41 fuel collecting chamber
43 fuel diffusion chamber
43*a* step

BEST MODES FOR CARRYING OUT THE INVENTION

Modes for carrying out the present invention are explained below with reference to the embodiments of the present invention shown in the attached drawings.

Figure 2:
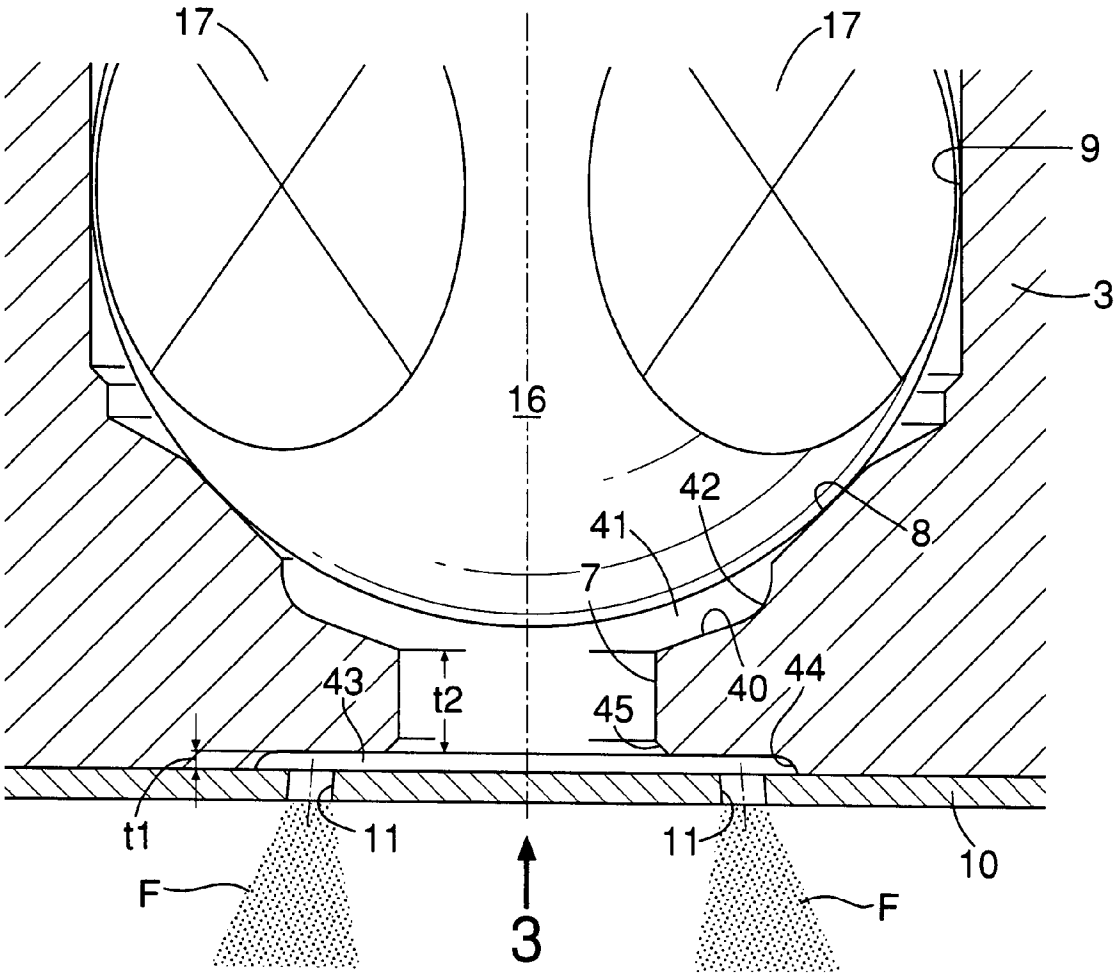
FIG. 2 is an enlarged view of an essential part of FIG. 1 (Embodiment 1).
Figure 3:
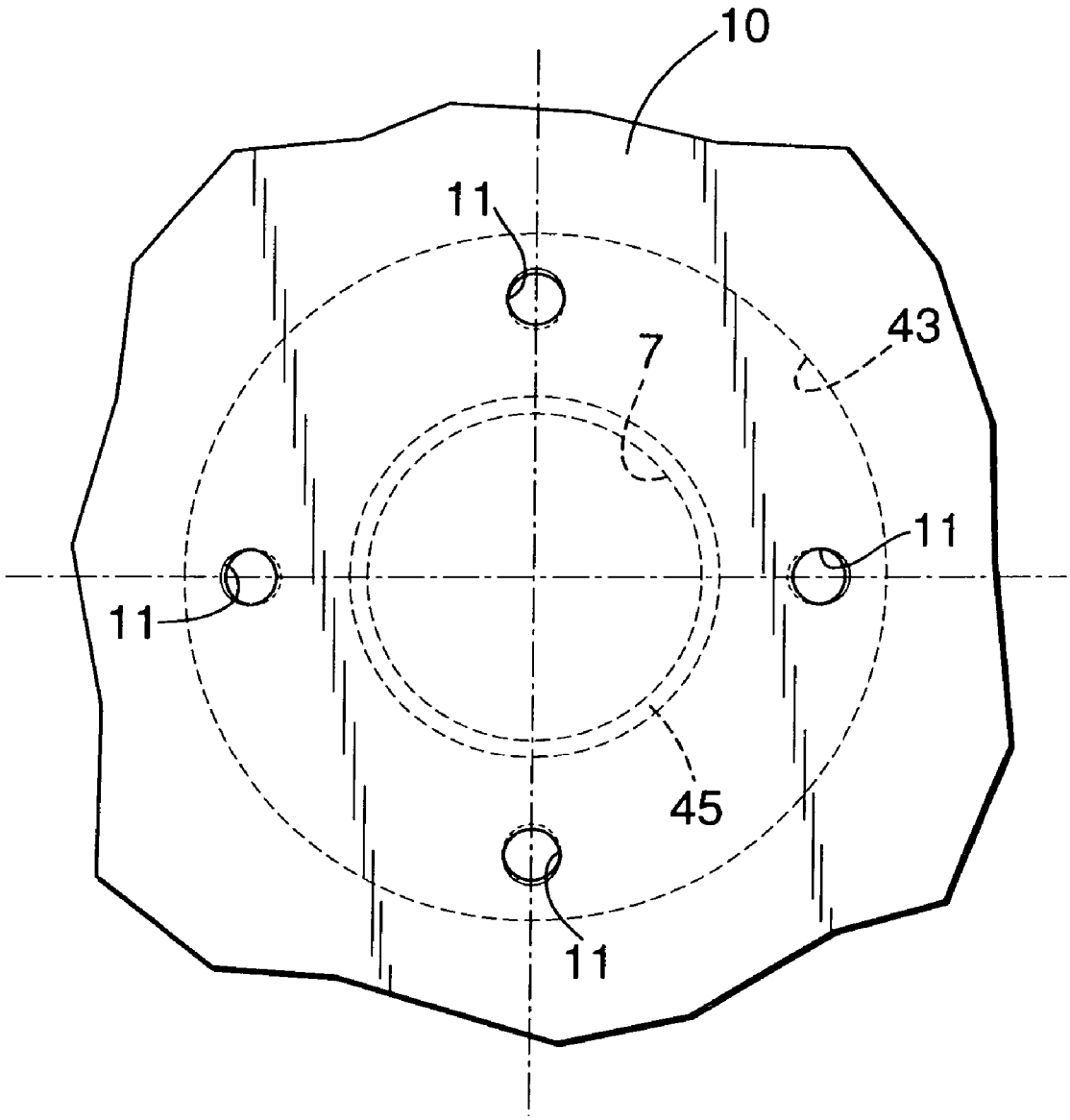
FIG. 3 is a view from arrow 3 in FIG. 2 (Embodiment 1).

The first embodiment of the present invention shown in FIG. 1 to FIG. 3 is now explained.

Embodiment 1

In FIG. 1, a casing 1 of a solenoid type fuel injection valve I for an internal combustion engine is formed from a cylindrical valve housing 2 (magnetic material), a bottomed cylindrical valve seat member 3 joined in a liquid-tight manner to the front end of the valve housing 2, and a cylindrical fixed core 5 joined in a liquid-tight manner to the rear end of the valve housing 2 via an annular spacer 4.

The spacer 4 is made of a non-magnetic metal such as, for example, stainless steel, and has the valve housing 2 and the fixed core 5 abutting against opposite end faces thereof and welded in a liquid-tight manner along the entire periphery.

Formed at opposing ends of the valve seat member 3 and the valve housing 2 are a first mating tubular portion 3*a* and a second mating tubular portion 2*a* respectively. The first mating tubular portion 3*a* is press-fitted into the second mating tubular portion 2*a* together with a stopper plate 6, the stopper plate 6 being held between the valve housing 2 and the valve seat member 3. By subsequently laser welding the entire periphery of a corner formed between an outer peripheral face of the first mating tubular portion 3*a* and an end face of the second mating tubular portion 2*a*, the valve housing 2 and the valve seat member 3 are joined to each other in a liquid-tight manner.

Formed in the valve seat member 3 are a conical valve seat 8, a valve seat hole 7 communicating with the downstream end of the valve seat 8, and a cylindrical guide hole 9 communicating with a large diameter portion of the valve seat 8, the guide hole 9 being formed coaxially with the second mating tubular portion 2*a*.

Welded in a liquid-tight manner along its entire periphery to the front end of the valve seat member 3 is a steel injector plate 10 (see FIG. 2) having a plurality of fuel injection holes 11 communicating with the valve seat hole 7.

Housed within the valve housing 2 and the spacer 4 is a movable core 12 opposing a front end face of the fixed core 5, and projectingly provided on an inner peripheral face of the spacer 4 is an annular guide face 13 axially slidably supporting the movable core 12.

The movable core 12 integrally includes a small diameter rod portion 15 extending from one end face of the movable core 12 to the valve seat 8 side, and a spherical valve portion 16 is secured to the tip of the rod portion 15 by welding, the valve portion 16 being capable of being seated on the valve seat 8. In this way, the movable core 12, the rod portion 15, and the valve portion 16 form a valve assembly 14.

The valve portion 16 is axially slidably supported in the guide hole 9, and the valve portion 16 has formed on the outer peripheral face thereof a plurality of flat sections 17 arranged at equal intervals, the flat sections 17 enabling fuel to flow within the guide hole 9.

The stopper plate 6 is provided with a cutout 18, through which the rod portion 15 runs, and a stopper flange 19 facing an end face, on the valve seat 8 side, of the stopper plate 6 is formed in an intermediate section of the rod portion 15. A gap is provided between the stopper plate 6 and the stopper flange 19 when the valve portion 16 is closed, that is, when the valve portion 16 is seated on the valve seat 8, the gap corresponding to the valve-opening stroke of the valve portion 16.

A gap is also provided between the fixed core 5 and the movable core 12, the gap being sufficient to avoid abutment of the cores 5 and 12 against each other even when the valve portion 16 is open, that is, when the valve portion 16 is detached from the valve seat 8.

The fixed core 5 has a hollow portion 21 communicating with the interior of the valve housing 2 via a through hole 20 of the movable core 12, and a coil-form valve spring 22 and a pipe-shaped retainer 23 that supports the rear end of the valve spring 22 are housed within the hollow portion 21, the valve spring 22 urging the movable core 12 in a direction in which the valve portion 16 is closed, that is, a direction in which the valve portion 16 is seated on the valve seat 8, and the retainer 23 being secured to the fixed core 5 by swaging the outer periphery of the fixed core 5. A positioning recess 24 is formed in a rear end face of the movable core 12, the recess 24 receiving the front end of the valve spring 22, and a set load of the valve spring 22 is adjusted by the position at which the retainer 23 is fixed to the fixed core 5.

Integrally provided with the rear end of the fixed core 5 is an inlet tube 26 having a fuel inlet 25 communicating with the hollow portion 21 of the fixed core 5 via the pipe-shaped retainer 23, the fuel inlet 25 being equipped with a fuel filter 27.

A coil assembly 28 is fitted around the outer peripheries of the spacer 4 and the fixed core 5. This coil assembly 28 is formed from a bobbin 29 fitted around outer peripheral faces of the spacer 4 and the fixed core 5 and a coil 30 wound around the bobbin 29, and one end of a coil housing 31 surrounding the coil assembly 28 is joined to an outer peripheral face of the valve housing 2 by welding.

The coil housing 31, the coil assembly 28, and the fixed core 5 are embedded within a synthetic resin cover 32, and a coupler 34 is integrally provided with an intermediate section of the cover 32, the coupler 34 housing a connecting terminal 33 connected to the coil 30.

An O ring 37 is mounted between a front end face of the cover 32 and a synthetic resin cap 35 fitted on the front end of the valve seat member 3, the O ring 37 being in intimate contact with an outer peripheral face of the valve seat member 3, and when this solenoid type fuel injection valve I is mounted in a fuel injection valve mounting hole of an intake manifold, which is not illustrated, the O ring 37 comes into intimate contact with an inner peripheral face of the mounting hole.

The structure of the area around the valve seat hole 7 of the valve seat member 3 is now explained in detail with reference to FIG. 2 and FIG. 3.

An annular depression 40 is formed in the valve seat member 3 between the downstream end of the valve seat 8 and the upstream end of the valve seat hole 7, this depression 40 providing a connection therebetween, and a fuel collecting chamber 41 being defined by means of the depression 40 and a front end face of the valve portion 16 of the valve assembly 14. The base of this fuel collecting chamber 41 has a conical shape, and an annular corner connecting between an inner peripheral face and the base of the fuel collecting chamber 41 is given a tapered or arc-shaped chamfer 42.

A flat fuel diffusion chamber 43 extending radially outward is formed between the valve seat member 3 and the injector plate 10, the downstream end of the valve seat hole 7 opening in a central part of the fuel diffusion chamber 43. In the illustrated example, this fuel diffusion chamber 43 is defined by an annular depression 44 formed in the front end face of the valve seat member 3 and an inside face of the injector plate 10. An annular corner connecting between an inner peripheral face of the valve seat hole 7 and a top face of the fuel diffusion chamber 43 is given a tapered or arc-shaped chamfer 45.

As shown in FIG. 3, the plurality of fuel injection holes 11 bored in the injector plate 10 are arranged on the circumference of a circle having the axis of the valve seat hole 7 as its center and are radially outwardly separated from the valve seat hole 7 so that the fuel injection holes 11 do not overlap the valve seat hole 7 in the axial direction. In this way, each of the fuel injection holes 11 communicates with the valve seat hole 7 via the fuel diffusion chamber 43.

The valve seat hole 7, the injector plate 10, and the fuel diffusion chamber 43 are formed so that, when the height of the fuel diffusion chamber 43 is t1, and the length of the valve seat hole 7 is t2, the following expression is satisfied.

$$t2/t1 \geqq 2 \quad (1)$$

In particular, the height t1 of a section of the fuel diffusion chamber 43 that the fuel injection holes 11 face is set at 20 to 110 μm.

The operation of this first embodiment is now explained.

As shown in FIG. 2, in a state in which the coil 30 is de-energized, the movable core 12 and the valve portion 16 are pushed forward by means of the urging force of the valve spring 22, thus seating the valve portion 16 on the valve seat 8. High pressure fuel that has been supplied into the valve housing 2 through the fuel filter 27 and the inlet tube 26 is therefore held in readiness within the valve housing 2.

When the coil 30 is energized by passing current, the magnetic flux thereby generated runs sequentially through the fixed core 5, the coil housing 31, the valve housing 2, and the movable core 12, and the movable core 12 of the valve assembly 14, together with the valve portion 16, is attracted to the fixed core 5 by means of the magnetic force, thus opening the valve seat 8. At this time, the stopper flange 19 of the valve assembly 14 abuts against the stopper plate 6 secured to the valve housing 2, thereby defining the valve-opening limit for the valve assembly 14.

When the valve seat 8 is opened, the high pressure fuel within the valve housing 2 passes through the conical valve seat 8 via the flat sections 17 of the valve portion 16 and then through the fuel collecting chamber 41, and goes down the valve seat hole 7.

During this process, since as in the expression (1) the length t2 of the valve seat hole 7 is set so as to be sufficiently large compared with the height t1 of the fuel diffusion chamber 43, the flow of fuel can be straightened effectively in the valve seat hole 7 and then moved to the fuel diffusion chamber 43, thus preventing the fuel from being retained in the valve seat hole 7. Moreover, since the corner formed between the valve seat hole 7 and the fuel diffusion chamber 43 is given the tapered or arc-shaped chamfer 45, it is possible for the fuel to move smoothly from the valve seat hole 7 to the fuel diffusion chamber 43, thus reducing any loss in flow rate.

The fuel that has moved from the valve seat hole 7 to the fuel diffusion chamber 43 spreads radially outward. During this process, since each of the fuel injection holes 11 of the injector plate 10 is disposed so as to be radially outwardly separated from the valve seat hole 7 as described above, the fuel that has passed through the valve seat hole 7 does not flow into the fuel injection holes 11 immediately, but spreads radially to fill the fuel diffusion chamber 43 and is then injected from each of the fuel injection holes 11.

In particular, since as in the expression (1) the height t1 of the fuel diffusion chamber 43 is set sufficiently small compared with the length t2 of the valve seat hole 7, the fuel that has flowed from the valve seat hole 7 into the fuel diffusion chamber 43 spreads radially outward at high speed and collides forcefully with an inner peripheral wall of the fuel diffusion chamber 43, thus enabling the pressure of each section of the fuel diffusion chamber 43 to be increased equally; as a result the fuel is injected from each of the fuel injection holes 11 with an equally high pressure in each section, and it is therefore possible to promote atomization of the fuel injected from the fuel injection holes 11 and stabilize the direction and the shape of a spray form F at all times. Moreover, since the fuel is not retained in the valve seat hole 7 and the fuel moves from the valve seat hole 7 to the fuel diffusion chamber 43 smoothly, it is possible to prevent the fuel flow rate from decreasing and ensure that a predetermined amount of fuel is injected.

Furthermore, when the height t1 of the section of the fuel diffusion chamber 43 that the fuel injection holes 11 face is set at 20 to 110 μm as described above, the fuel that has moved from the valve seat hole 7 to the fuel diffusion chamber 43 spreads radially at high speed in film form, and when this fuel in film form is injected from the fuel injection holes 11 at high speed, the fuel flow is detached from the inner peripheral wall of the fuel injection holes 11, thus enabling atomization of the injected fuel to be promoted yet more effectively. Moreover, it is possible to minimize dead volume due to the fuel diffusion chamber 43, thus stabilizing the fuel flow rate characteristics against changes in temperature. Furthermore, outflow of fuel remaining in the fuel diffusion chamber 43 is avoided due to the capillary action, thus preventing the fuel from dripping from the fuel injection holes 11 after fuel injection and thereby enabling a contribution to be made to a reduction in the exhaust emissions of the internal combustion engine.

If the height t1 of the fuel diffusion chamber 43 is less than 20 μm, the flow resistance of the fuel diffusion chamber 43 increases rapidly, and it becomes difficult to obtain a predetermined fuel flow rate.

Figure 4:
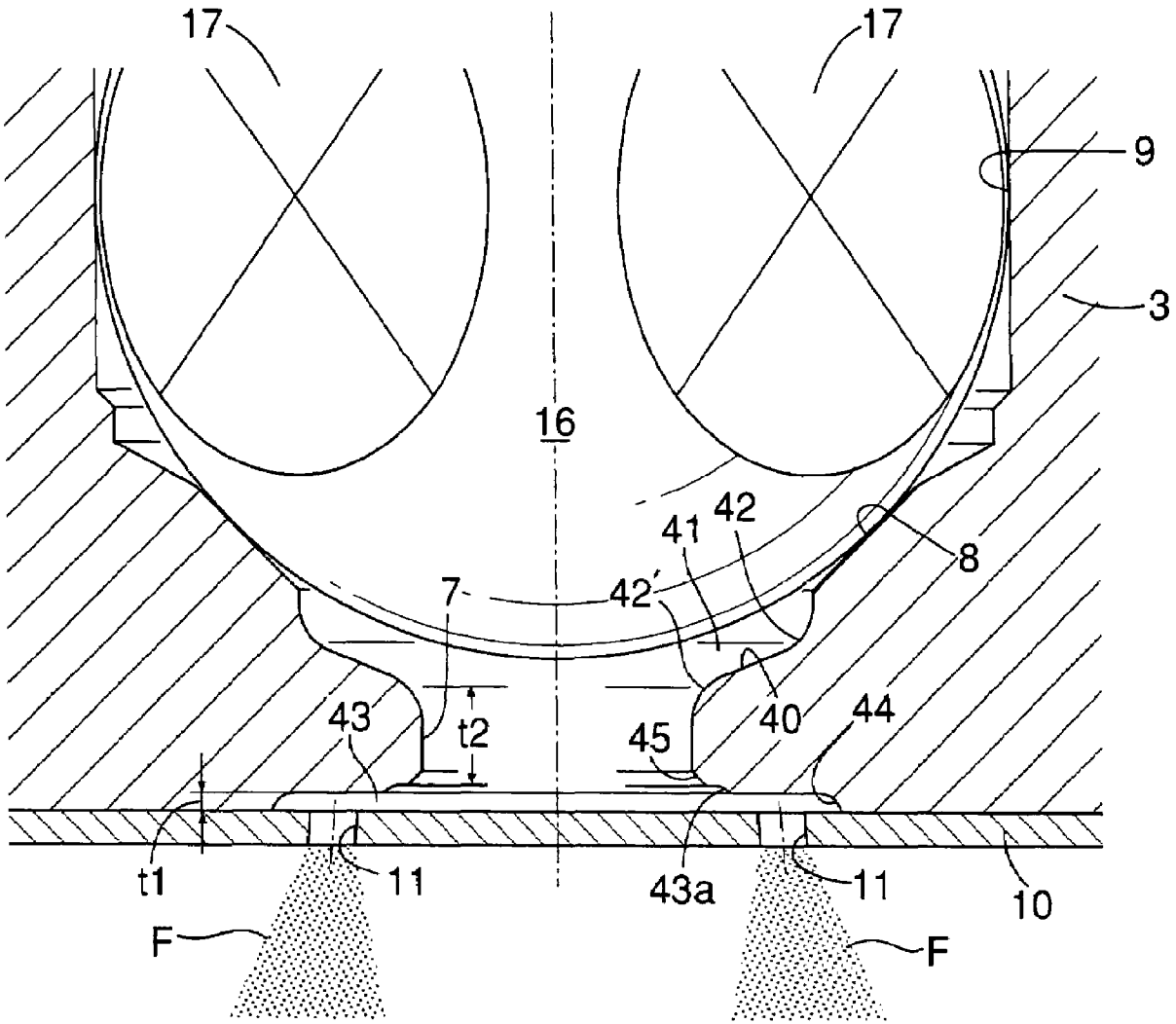
FIG. 4 is a sectional view, corresponding to FIG. 2, of a second embodiment of the present invention (Embodiment 2).

A second embodiment of the present invention shown in FIG. 4 is now explained.

Embodiment 2

In this second embodiment, one or a plurality of annular steps 43*a* that are concentric with a valve seat hole 7 are formed on a top face of a fuel diffusion chamber 43, and as a result the height t1 of the fuel diffusion chamber 43 reduces as it goes radially outward from a central portion of the fuel diffusion chamber 43. This step 43*a* is formed in a tapered or arc shape so as not to interfere with spreading of the fuel. An annular corner connecting between the base of the fuel collecting chamber 41 and an inner peripheral face of the valve seat hole 7 is given a tapered or arc-shaped chamfer 42'.

Since the rest of the arrangement is the same as that of the preceding embodiment, parts of FIG. 4 corresponding to those of the preceding embodiment are denoted by the same reference numerals and symbols and explanation thereof is omitted.

In accordance with this second embodiment, the fuel diffusion chamber 43 has a logical shape that substantially corresponds to the flow of fuel, that is, the height of the fuel diffusion chamber 43 decreases as the fuel spreads radially outward. As a result, the pressure of the fuel diffusion chamber 43 can be increased yet more equally in each section by the fuel that has moved from the valve seat hole 7 to the fuel diffusion chamber 43, thus yet further promoting atomization of the fuel injected from the fuel injection holes 11 and yet further stabilizing the spray form.

Figure 5:
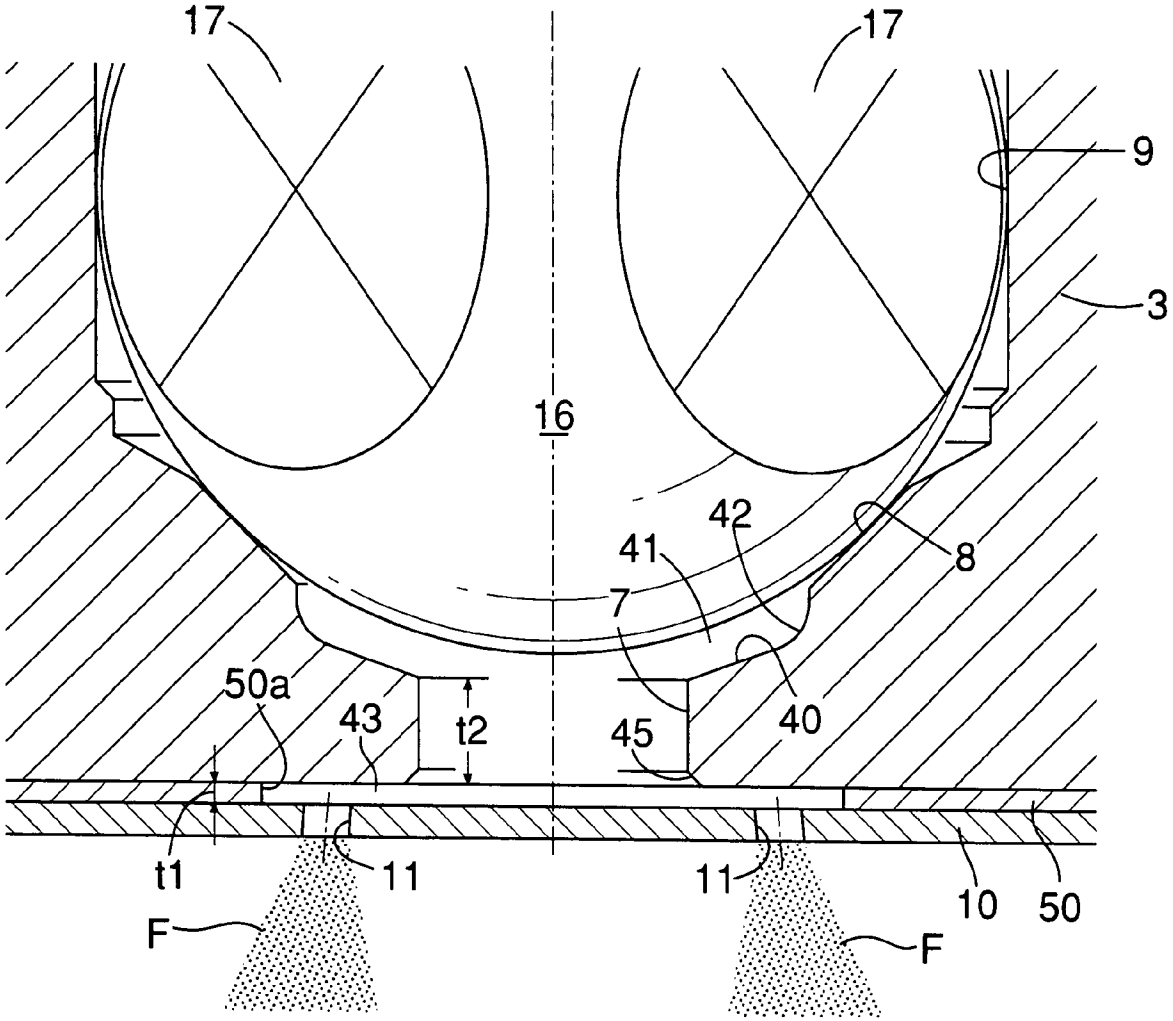
FIG. 5 is a sectional view, corresponding to FIG. 2, of a third embodiment of the present invention (Embodiment 3).

Finally, a third embodiment of the present invention shown in FIG. 5 is explained.

Embodiment 3

In this third embodiment, a middle plate 50 is connected between a valve seat member 3 and an injector plate 10, the middle plate 50 having an opening 50*a* corresponding to a fuel diffusion chamber 43. Since the rest of the arrangement is the same as that of the preceding embodiment, parts of FIG. 5 corresponding to those of the preceding embodiment are denoted by the same reference numerals and symbols and explanation thereof is omitted.

In accordance with this third embodiment, the fuel diffusion chamber 43 can be formed simply by subjecting the middle plate 50 to a press punching-out process.

The present invention is not limited to the above-mentioned embodiments and can be modified in a variety of ways without departing from the spirit and scope thereof. For example, in the first embodiment shown in FIG. 2, the depression 44 for forming the fuel diffusion chamber 43 may be provided on the injector plate 10 side. Furthermore, in the second embodiment shown in FIG. 4, instead of the annular step 43*a*, the top face of the fuel diffusion chamber 43 may be formed with a continuous conical face.

The invention claimed is:

1. A fuel injection valve comprising a valve assembly having a valve portion; a valve seat member having provided therein a conical valve seat and a valve seat hole, the valve seat cooperating with the valve portion, and the valve seat hole communicating with a downstream end of the valve seat; an injector plate, the injector plate being joined to the valve seat member; a radially extending and annular fuel diffusion clamber, the fuel diffusion chamber being formed between the valve seat member and the injector plate, and a downstream end of the valve seat hole opening in a central part of the fuel diffusion chamber; and a plurality of fuel injection holes, the fuel injection holes being bored in tie injector plate so as to be radially outwardly separated from the valve seat hole and open to an inside of the fuel diffusion chamber;

wherein an annular depression is formed in the valve seat member between the downstream end of the valve seat and an upstream end of the valve seat hole so as to provide a connection therebetween, a fuel collecting chamber is defined by the depression and a front end face of the valve portion of the valve assembly, and the fuel collecting chamber has a base of conical shape, wherein the valve seat hole is formed such that, when the height of the fuel diffusion chamber is t1 and the length of the valve seat hole is t2, t2/t1≧2, thereby straightening a flow of fuel from the fuel collecting chamber, wherein an annular corner is formed to connect between the base of the fuel collecting chamber and an inner peripheral face of the valve seat hole, said annular corner having a tapered or arc-shaped chamfer, and wherein the fuel diffusion chamber is defined by an annular depression formed in a front end face of the valve seat member such that the height of a section of the fuel diffusion chamber that the fuel injection holes face is 20 to 110 μm to make the fuel diffusion chamber flat and thin relative to the length of the valve seat hole so that the flow of fuel spreads radially at high speed in film form in the fuel diffusion chamber and is detached from an inner peripheral wall of the fuel injection holes.

2. The fuel injection valve according to claim 1, wherein a corner is formed to connect between a top face of the fuel diffusion chamber and the inner peripheral face of the valve seat hole, said corner being given a tapered or arc-shaped chamfer.

* * * * *